United States Patent [19]

Dorris

[11] 4,434,517

[45] Mar. 6, 1984

[54] INVALID'S BATHTUB

[76] Inventor: Gordon L. Dorris, 2445 Mobile Dr., Boise, Id. 83709

[21] Appl. No.: 371,920

[22] Filed: Apr. 26, 1982

[51] Int. Cl.[3] ..... A47K 3/06

[52] U.S. Cl. ..... 4/585; 4/559

[58] Field of Search ..... 4/538, 546, 548, 559, 4/560, 580, 584, 585, 586, 587, 595, 526, 527, 534

[56] References Cited

U.S. PATENT DOCUMENTS

| | | | |
|---|---|---|---|
| 2,567,514 | 9/1951 | Hoffman | 4/587 |
| 3,755,830 | 9/1973 | Johns | 4/585 |
| 4,383,635 | 5/1983 | Yotoriyama | 220/401 |

FOREIGN PATENT DOCUMENTS

| | | | |
|---|---|---|---|
| 647577 | 12/1950 | United Kingdom | 4/587 |

*Primary Examiner*—Stephen Marcus
*Assistant Examiner*—Kenneth S. Putnam
*Attorney, Agent, or Firm*—Paul F. Horton

[57] ABSTRACT

A bathtub especially for use on a bed and comprising a flexible liner, one rigid support frame for each of two side walls, frame holding means for each side wall, and a support beam between each side wall to hold said frames upright and spaced apart such that the end walls of said flexible liner will also be held upright by tension; and a method of bathing a bedridden person using said bathtub by sliding said flexible liner under said person, installing said frames in planar contact with said sidewalls, installing said beams to hold said side walls and said end walls upright, and filling said bathtub as desired.

2 Claims, 7 Drawing Figures

INVALID'S BATHTUB

BACKGROUND OF THE INVENTION

Bedridden invalids are subject to numerous problems, including the inability to bathe adequately, the propensity to develop bedsores, and in the case of arthritic patients, the difficulty encountered in warming all the affected joints simultaneously. Thus, there has been a long felt need to provide such patients with an apparatus which will permit them to be immersed in water without leaving their beds. Evidence of this long felt need can be seen in U.S. Pat. No. 573,625 to Ruffner entitled "Invalid's Bath Tub", issued Dec. 22, 1896. Ruffner attempted to fill the need by providing a flexible liner which could be slipped under the patient and then given rigidity by inflating tubes judiciously built into the liner. A series of improvement patents continued to be issued up to the present day; most of the improvements attempting to solve the problem of inadequate rigidity. Some recent examples are U.S. Pat. No. 4,068,326 to Deschler and U.S. Pat. No. 3,681,789 to Bott.

Another avenue which has been taken in the attempt to solve this long felt need is to provide a rigid framework fastened to and supported by the bed, and in turn supporting a flexible liner. Examples of this type of solution can be found in U.S. Pat. No. 3,373,451 (Schmidt) and 3,246,346 (Schmidt). This concept depends from the invention described in U.S. Pat. No. 778,641 (Dudley, Redoubt), although that invention was not intended to be used in conjunction with a bed or invalids. These inventions solve the problem of inadequate rigidity found in inflatible tubs, but they suffer from complexity of assembly.

SUMMARY OF THE INVENTION

It is an object of this invention to provide a sturdy means for immersing a bedridden person in water or the like.

It is another object of the invention to provide a bathtub which is lightweight, compact, and easily portable when not in use.

It is a further object of the invention to provide a bathtub which can be assembled quickly and easily.

It is a further object of the invention to provide a bathtub which can be manufactured inexpensively.

These and other objects are met by a bathtub comprising a flexible liner to slide under the patient, a rigid frame to support the wall of the tub on each side of the patient, a pocket to accept said rigid frame into the wall of the liner on each side of the patient, and a rigid beam across the head end and the foot end of the liner with pins on each end of each beam to insert into holes in the rigid frames so as to hold said frames approximately upright and spaced apart so as to hold up the end walls of the flexible liner.

Thus, with only five parts, a bathtub can be placed and assembled in a matter of minutes. Although each part of the assembly fulfills an apparently simple function, the unique and at first unapparent series of female-male joints (from liner pocket to frame to hole to pin) results in a surprising structure far superior to what would be expected from an aggregation of such insignificant components. The long sought solution to this perplexing problem turns out to have been elusive not because of its complexity, but because of its simplicity once it has been recognized.

To use the invention, the attendant merely slides the flexible liner under the patient, inserts the two rigid frames in their pockets, inserts each pin of a beam into a hole in one end (e.g., the foot end) of each rigid frame, similarly installs the other beam at the other end, and fills the resulting tub as desired. This astounding ease of assembly is as surprisingly impressive as is the quality of the resulting tub.

Thus, the key elements of the invention are (1) the flexible liner, (2) the rigid frames held in planar contact with both longitudinal sides of said liner, and (3) the beams supporting and separating said rigid frames.

DETAILED DESCRIPTION OF THE INVENTION

Figure 1:
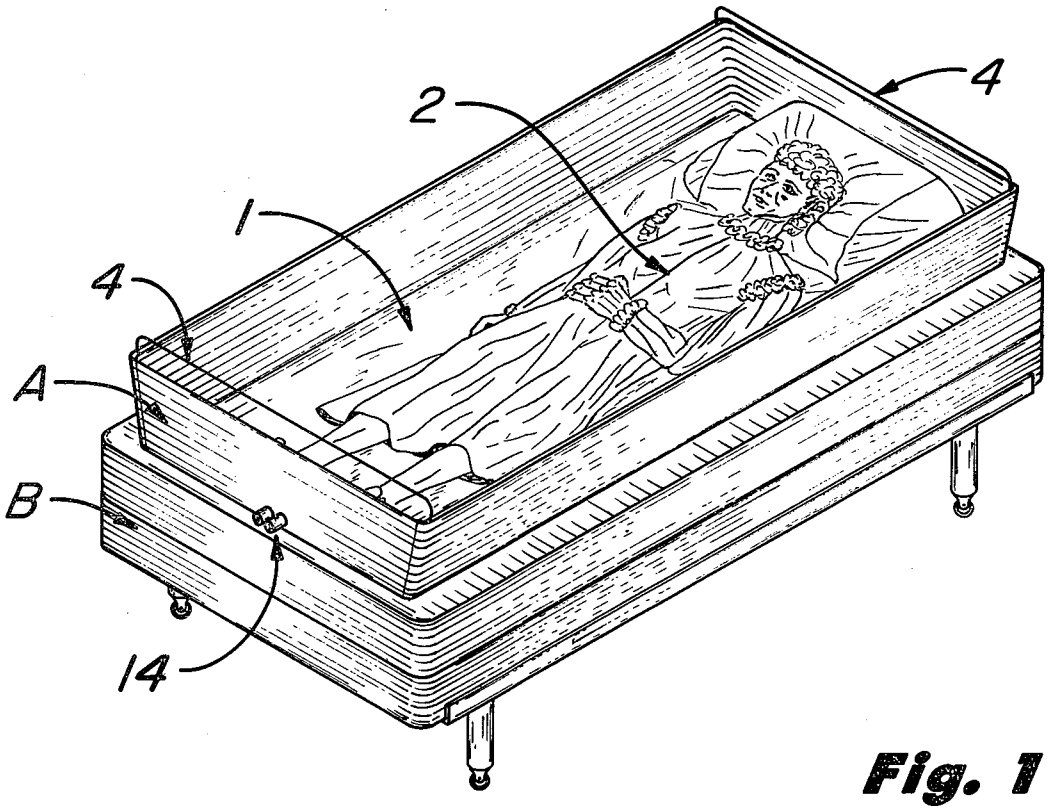
FIG. 1 is an isometric view of the invention in use.

Referring now to FIG. 1, the invention, generally designated as A, comprises a bathtub designed to be used particularly on a bed B, especially for use in bathing a bed-ridden patient 2; said bathtub having an essentially horizontal floor, two approximately upright side walls, two approximately upright end walls, and supporting means.

Figure 2:
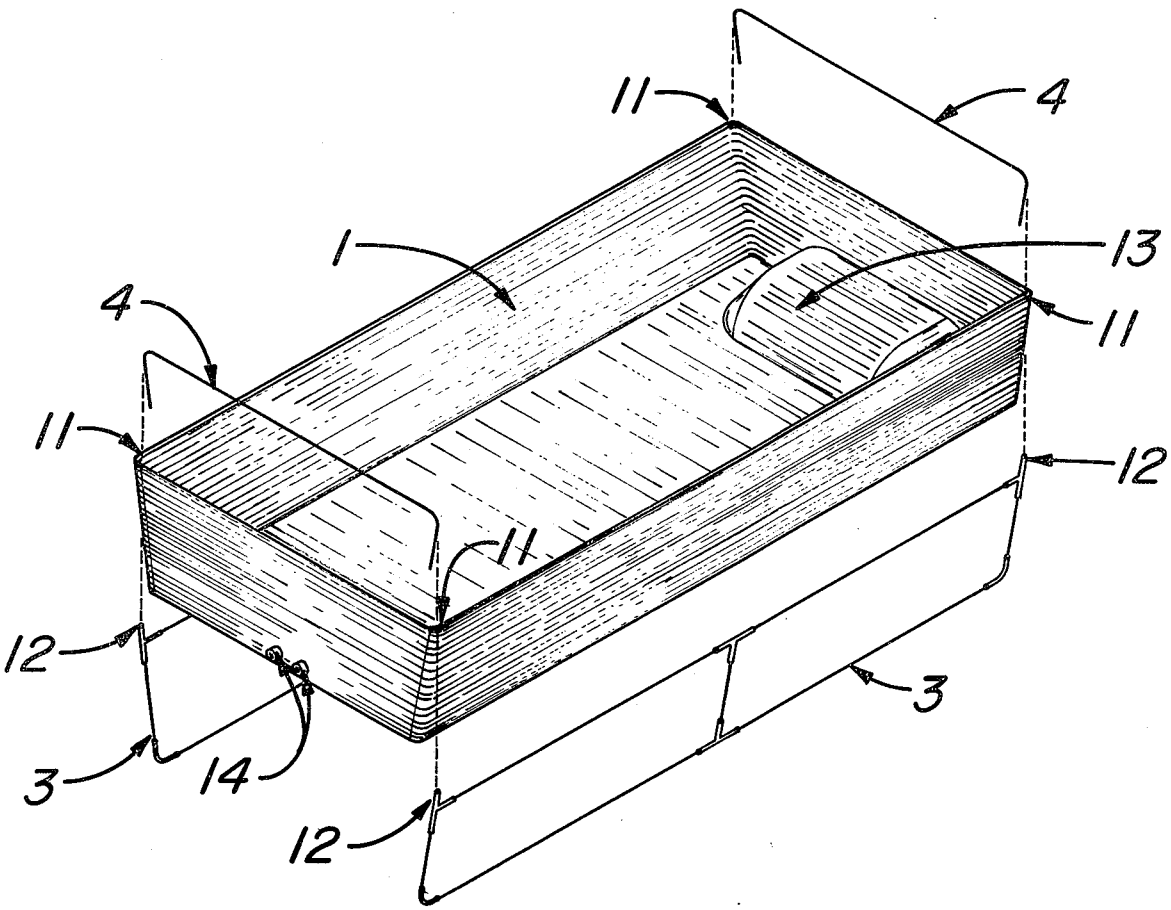
FIG. 2 is an exploded isometric showing the various parts of the invention and their relationships one to another.

Referring now to FIG. 2, the various parts of said bathtub can be seen as comprising a flexible waterproof liner 1 with each longitudinal side comprising an external bottom-opening pocket, one rigid frame 3 to fit snugly inside each of said pockets, a spacer beam 4 at each end of said liner 1 to locate and immobilize said rigid frames 3, and holes 11 in the top of each end of each said pockets to permit the interconnection of said rigid frames 3 with said spacer beams 4. A pillow bubble 13 and valved filler, drain, and circulation ports 14 are desirable but non-essential features which can be incorporated into the liner 1.

In the preferred embodiment, holes 12 in the top of each end of said rigid frames 3 accept pin-elements of said spacer beams 4, thereby providing said interconnection of said frames 3 with said beams 4. It has also been found desirable to manufacture said liner 1 so that the longitudinal sides thereof will have a slight inward taper when said bathtub is fully assembled.

Figure 3:
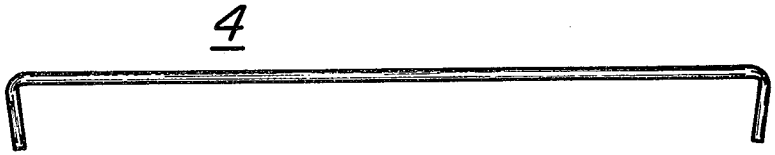
FIG. 3 is an elevation view of a rod-type spacer beam for use with the invention.
Figure 4:
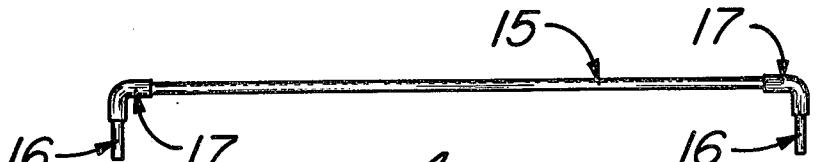
FIG. 4 is an elevation view of a pipe-type spacer beam for use with the invention.

Referring now to FIGS. 3 and 4, two optional means of manufacturing said spacer beams 4 can be seen. The spacer beam 4 shown in FIG. 3 is a single metal rod or pipe which has been bent sharply at each end to form a wide horseshoe shaped unit. The short, approximately upright lengths of rod or pipe (i.e. pins) at each end of said beam 4 fit into said holes 12 in the top of said frames 3. The spacer beam 4 shown in FIG. 4 comprises a single approximately horizontal length 15 of ½-inch heavy wall PVC pipe and a short approximately upright length 16 of ½-inch PVC pipe (i.e. a pin) connected to each end of said horizontal pipe by a 90° pipe ell 17 so as to fit into said frame holes 12. Although the type of beam 4 shown in FIG. 4 precludes aligning said pins 16 to exactly correspond with the desired taper of the longitudinal sides of said bathtub A, sufficient tolerance can be left between said pins 16 and said holes 12 to permit proper assembly. Other acceptable methods of manufacture of said spacer beams 4 will no doubt be easily conceived by those skilled in the art.

Figure 5:
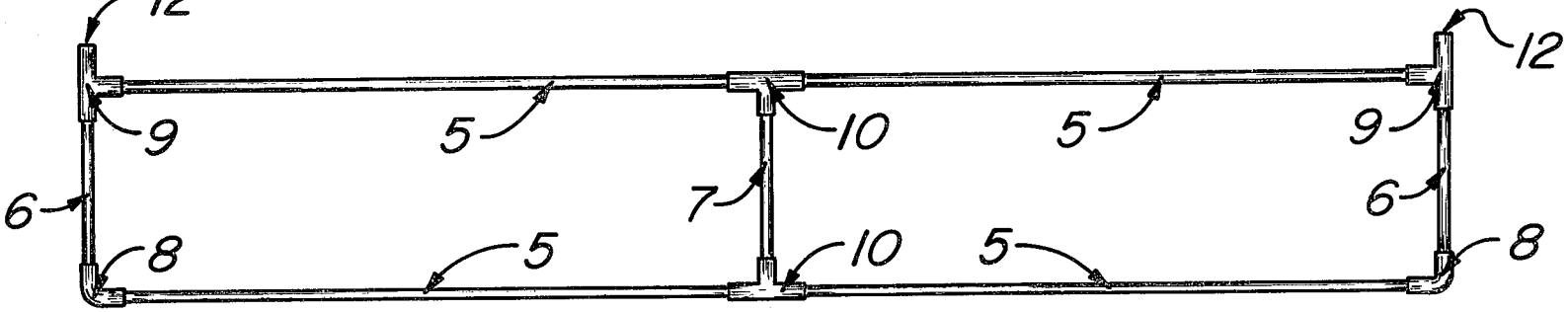
FIG. 5 is an elevation view of a pipe-type rigid side frame for use with the invention.

Referring now to FIG. 5, a pipe-type rigid side frame 3 can be seen. Although other types of side frames (including dimension lumber and specially extruded hollow plastic boards) have been conceived, the pipe-type frame is preferred because of its light weight, ease of manufacture, and high portability. Said pipe-type rigid side frame 3 comprises four approximately horizontal members 5, two approximately upright end members 6, and one approximately upright central member 7, each of said members using ½-inch heavy wall PVC pipe. The central member 7 is connected at its top, and likewise at its bottom, to two of said horizontal members 5 by a pipe tee 10. Each of said end members 6 is connected at its bottom to one said horizontal member 5 by a pipe ell 8, and at its top to one horizontal member 5 by a pipe tee 9. The top, unused socket 12 of said pipe tee 9 comprises said hole 12 in the top of each end of said frame 3. It has been found that the tolerance between said socket 12 and said pin 16 of said pipe-type beam 4 shown in FIG. 4 is adequate to permit assembly of said bathtub A with the desired slope of said liner's longitudinal sides.

Figure 6:
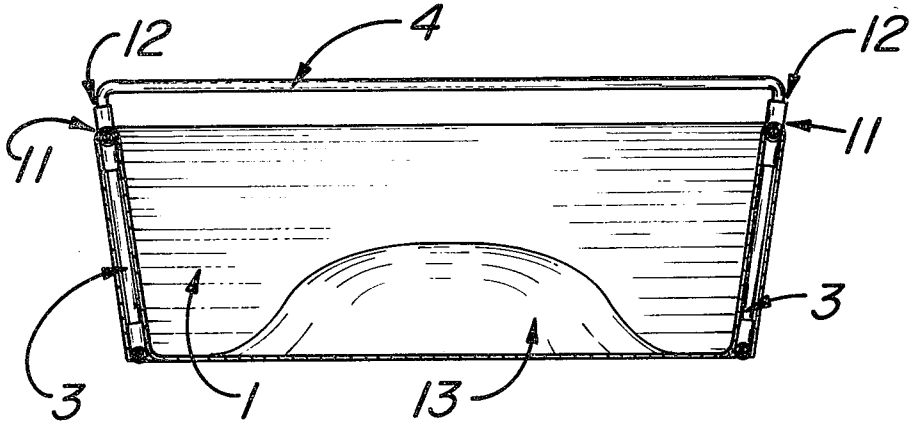
FIG. 6 is a transverse section through the assembled invention.

Referring now to FIG. 6 the essential relationships between the various components in their assembled state can be seen. These relationships are: Said rigid side frames 3 are inside of the bottom opening side pockets of said liner 1, thereby being held firmly in planar contact with the outside wall of the bathtub's side; the tops of said pipe tees 9 protrude through holes 11 in line 1; the pins of said beams 4 are snugly inside of said sockets 12, thereby holding said frames 3 essentially upright and spaced apart such that the end-wall of said liner 1 is taut. The optional pillow bubble 13 which can be formed in said liner 1 is also shown in FIG. 6. As can be determined from FIG. 6, the side pockets are formed by bending back onto the outer surface of each bathtub side an extension from the top of said slide's waterproof liner material and then fastening the ends of the resulting flap to said side, thereby producing an approximately upright seam at each end of said side; the combination of each side, flap, and pair of seams yielding said bottom opening pocket. In FIG. 6 the metal-rod type beam 4 shown in FIG. 3 is depicted, although the pipe-type beam 4 of FIG. 4 would look essentially the same. Additional support and spacing means (including inflatable tubes or a single beam with two pins on each end) have been conceived, and other adequate means will no doubt be conceived by those skilled in the art.

Figure 7:
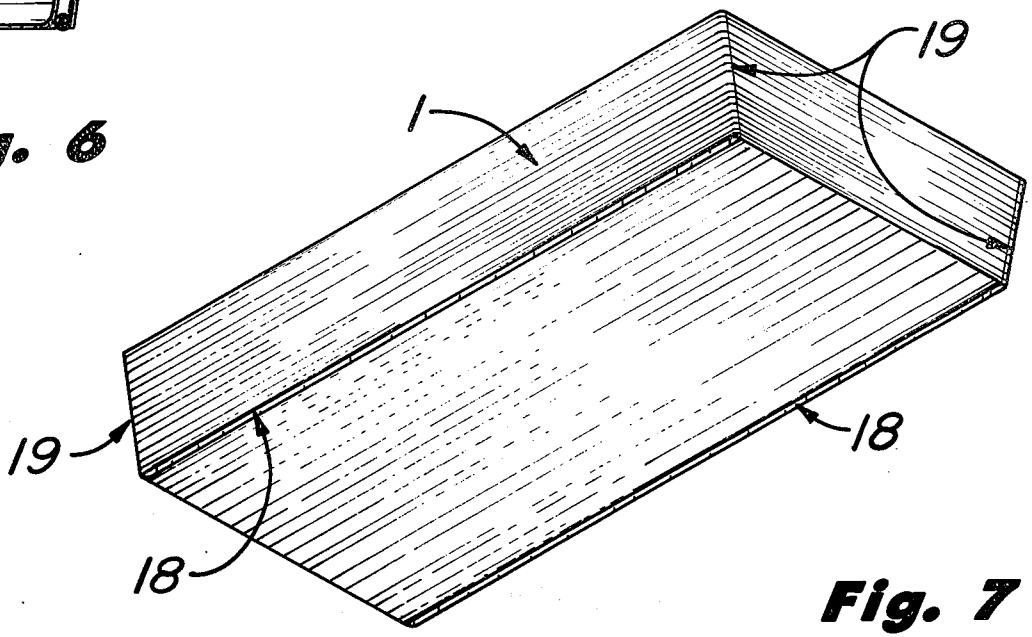
FIG. 7 is an isometric view of the liner of the invention from the bottom and especially showing the bottom opening pockets thereof.

Referring now to FIG. 7, the above described pockets 18 can be seen from below. Expecially visible in this view are the bottom opening of said pockets 18 and the seams 19 at the ends of said pockets. Other less desirable side frame holding means (including ties, snapping tabs, or loops) have been conceived, and additional adequate side holding means will no doubt be conceived by those skilled in the art.

To use said bathtub A, an attendant slides said liner 1 under said patient 2, and approximately centers said patient 2 thereon. A rigid frame 3 is inserted into each of said bottom opening pockets 18 of said liner 1 such that the tops of said pipe tees 9 protrude through said holes 11 in the tops of said pockets. A pin of one of said beams is then inserted into the socket 12 in one of said pipe tees 9 of one of said frames 3. The other pin of said beam is then inserted into the corresponding (i.e. same end) socket of the other said frame 3. The other beam 4 is installed in the same manner on the opposite end of said frames 3. The resulting bathtub A is then filled as desired. A pillow may be placed under said patient's head at any time after said liner is in place beneath said patient.

The above described embodiment provides a novel and practical means for achieving the objectives set forth. Although described in the foregoing specification in the preferred embodiment, it will be apparent to those skilled in the art that numerous embodiments and applications of the various novel features of this invention could be conceived which would not change the overall inventive concepts contained therein. Hence, the scope of this invention is not limited; by this specification, but is to be construed in accordance with the following claims.

I claim:

1. An invalid's bathtub comprising:

a supporting framework having a pair of side frames and a pair of end frames, said side frames each including a pair of vertically spaced horizontal members connected at opposing ends by a pair of vertically spaced end members, said end members each provided at their uppermost opposing terminal ends with a pin-socket joint member; and each of said end frames including at least one horizontal member provided at opposing ends with a mating pin-socket joint member temporarily engagable with a respective pin-socket joint member of each of the end members of each of said side frames to produce a boxlike framework; and a watertight, flexible liner having a bottom section, two opposing side wall sections and two opposing end wall sections defining a boxlike reservoir when in use, said liner provided with a pair of side panels, each of said side panels connected at its sides and top to a respective side wall section of said liner to define a bottom opening pocket adapted to slip over and be held in place by respective side frame of said supporting framework, without fasteners, and said liner provided with openings for accommodating respective pins of said pin-socket joint members.

2. The apparatus as described in claim 1, wherein opposing side wall sections and opposing end wall sections of said liner are inwardly tapered toward one another.

* * * * *